US010277970B2

(12) United States Patent
Horn et al.

(10) Patent No.: US 10,277,970 B2
(45) Date of Patent: Apr. 30, 2019

(54) MICROPHONE UNIT FOR AN ACTION CAMERA

(71) Applicant: Sennheiser Electronic GmbH & Co. KG, Wedemark (DE)

(72) Inventors: Michael Horn, Harsum (DE); Manfred Kurbis, Wedemark (DE); Lars Heine, Schwulper (DE); Raimund Staat, Burgwedel (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 15/693,617

(22) Filed: Sep. 1, 2017

(65) Prior Publication Data

US 2018/0070161 A1 Mar. 8, 2018

(30) Foreign Application Priority Data

Sep. 2, 2016 (DE) ..... 10 2016 116 424

(51) Int. Cl.
*H04R 1/08* (2006.01)
*H04R 1/02* (2006.01)
(Continued)

(52) U.S. Cl.
CPC ..... *H04R 1/086* (2013.01); *H04R 1/028* (2013.01); *H04R 1/44* (2013.01); *H04R 1/283* (2013.01); *H04R 2499/11* (2013.01)

(58) Field of Classification Search
CPC ..... H04R 1/086; H04R 1/128; H04R 1/44; H04R 2499/11
(Continued)

(56) References Cited

U.S. PATENT DOCUMENTS 7,466,838 B1 * 12/2008 Moseley ..... G10K 11/178 381/370
2002/0017424 A1 * 2/2002 Pavlovic ..... H04R 1/086 181/242
(Continued)

FOREIGN PATENT DOCUMENTS

DE 2 545 993 4/1976
DE 197 15 365 10/1998
(Continued)

*Primary Examiner* — William A Jerez Lora
(74) *Attorney, Agent, or Firm* — Haug Partners LLP

(57) ABSTRACT

There is provided a microphone unit (1) for an action camera, comprising a microphone capsule (10) having at least one speaking hole (11), and a water-tight enclosure (20) which water-tightly encloses the microphone capsule (10). The water-tight enclosure (20) has a water-impermeable passive diaphragm (25) which can oscillate freely and which allows incoming sound to pass substantially undisturbed. The microphone unit has a head (30) having a plurality of holes (31), the head (30) being provided outside the enclosure (20) in front of the passive diaphragm (25). The microphone unit further has a foam portion (40) which is provided in front of the head (30) and has an open-pore foam. The foam portion (40) is in contact with the head (30). The passive diaphragm (25) has an oscillatable minimum area of 20 $mm^2$; wherein the foam portion (40) has pores which are sufficiently small so that the foam portion (40) can suck water residues away from the holes (31) in the head (30) like a sponge. At the same time however the pores are of such a size that they cannot independently retain water so that water residues, after removal of the microphone unit (1) from the water, run for the greatest part out of the foam portion (40) downwardly under the effect of the force of gravity; wherein the foam portion (40) has a predominant pore density of 15 ppi to 80 ppi.

7 Claims, 3 Drawing Sheets

(51) Int. Cl.
*H04R 1/44* (2006.01)
*H04R 1/28* (2006.01)

(58) Field of Classification Search
USPC ..... 381/91, 112–115, 122, 124, 175, 355, 381/369, 375
See application file for complete search history.

(56) References Cited

U.S. PATENT DOCUMENTS

| | | | | |
|---|---|---|---|---|
| 2006/0140432 | A1 | 6/2006 | Ueki | |
| 2008/0195390 | A1* | 8/2008 | Almagro | H04M 1/19 704/246 |
| 2010/0111345 | A1 | 5/2010 | Andrea et al. | |
| 2014/0211974 | A1* | 7/2014 | Pielsticker | H04R 1/086 381/359 |
| 2016/0234594 | A1 | 8/2016 | Ogura et al. | |
| 2018/0035203 | A1* | 2/2018 | Hirai | H04M 1/02 |

FOREIGN PATENT DOCUMENTS

| | | |
|---|---|---|
| JP | H07245794 | 9/1995 |
| JP | 4456656 | 4/2010 |
| WO | WO 2006/128956 | 12/2006 |

* cited by examiner

MICROPHONE UNIT FOR AN ACTION CAMERA

RELATED APPLICATION

The present application claims priority to German Application No. 102016116424.0, filed on Sep. 2, 2016, the entirety of which is incorporated herein by reference.

FIELD OF INVENTION

The present invention concerns a microphone unit for an action camera and an action camera having a microphone unit.

BACKGROUND

Action cameras like for example actioncams from GoPro typically have an incorporated microphone. The action cameras are optionally provided with a water-tight reverberant case. As a result the quality of audio recording under that case by the incorporated microphone is however poor.

DE 197 15 365 C2 discloses a condenser microphone having a microphone housing and a first diaphragm and a second diaphragm which is provided in the form of a passive freely oscillating sealing diaphragm. If however such microphones are immersed in water it often happens that drops of water remain on the speaking hole and thus close off the speaking hole.

In the German patent application from which priority is claimed the German Patent and Trade Mark Office searched the following state of the art: JP 4456656 B1, US 2006/140432 A1, JP H07245794 A, US 2016/234594 A1, WO 2006/128956 A1, DE 197 15 365 A1, US 2014/211974 A1, US 2010/111345 A1 and DE 2 545 993 A1.

SUMMARY

An object of the present invention is to provide a microphone unit which is operable under water and permits effective sound pickup or sound recording.

That object is attained by a microphone unit as set forth in claim 1.

Thus there is provided a microphone unit for an action camera, comprising a microphone capsule having at least one speaking hole, and a water-tight enclosure which water-tightly encloses the microphone capsule. The water-tight enclosure has a water-impermeable passive diaphragm which can oscillate freely and which allows incoming sound to pass substantially undisturbed. The microphone unit has a head having a plurality of holes, the head being provided outside the enclosure in front of the passive diaphragm. The microphone unit further has a foam portion which is provided in front of the head and has an open-pore foam. The foam portion is in contact with the head. The passive diaphragm has an oscillatable minimum area of 20 $mm^2$. The foam portion has pores which are sufficiently small so that the foam portion can suck water residues away from the holes in the head like a sponge. At the same time the pores are of such a size that they cannot independently retain water so that water residues, after removal of the microphone unit from the water, run for the greatest part out of the foam portion downwardly under the effect of the force of gravity. The foam portion has a predominant pore density of 15 ppi to 80 ppi.

According to an aspect of the present invention the microphone unit has a carrier layer for supporting the passive diaphragm. The carrier layer is arranged within the enclosure behind the passive diaphragm. The carrier layer is arranged spaced from the passive diaphragm so that it does not contact the passive diaphragm in normal operation.

According to an aspect of the present invention the microphone unit has a holder which fixes the microphone unit to a housing of an action camera.

According to a further aspect of the present invention the holder is flexible.

According to a further aspect of the present invention the diameter of the speaking hole is 0.5 to 2.5 mm.

According to a further aspect of the present invention the region of the enclosure at which the passive diaphragm is fixed is of such a configuration that there is no peripherally extending raised portion around the edge of the passive diaphragm.

The microphone unit according to the invention is intended to prevent drops of water from remaining on or in the microphone unit after the microphone unit is removed from the water, and thus closing off the speaking hole, so that effective pickup or recording of airborne sound is not possible.

According to the invention there is provided a microphone unit which, immediately after emergence from water, has the desired acoustic properties without impairment, wherein at the same time good mechanical protection and wind noise suppression are to be provided.

According to an aspect of the present invention there is provided a microphone unit for an actioncam or action camera. The microphone unit has a microphone capsule having a speaking hole, a water-tight enclosure having a water-impermeable passive diaphragm which is of a minimum size. The diaphragm has water-repellent properties. In addition there is provided a microphone head having a plurality of holes, which surrounds the passive diaphragm at one side. The microphone unit further has a foam portion which encloses the head. The foam portion has open-pore foam with a predominant pore size.

Further configurations of the invention are subject-matter of the appendant claims.

BRIEF DESCRIPTION OF DRAWINGS

Advantages and embodiments by way of example of the invention are described in greater detail hereinafter with reference to the drawing.

DETAILED DESCRIPTION

Figure 1:
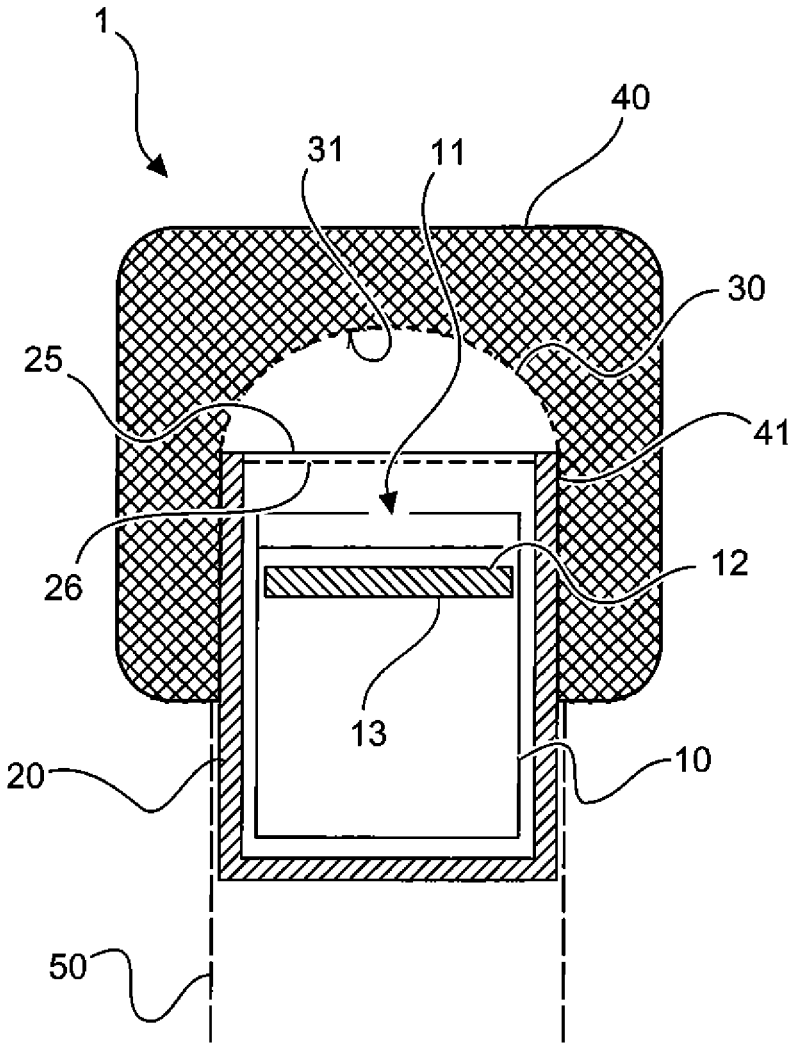
FIG. 1 shows a diagrammatic sectional view of a microphone unit according to a first embodiment.

FIG. 1 shows a diagrammatic sectional view of a microphone unit 1 according to the first embodiment. The microphone unit 1 of the first embodiment is provided as an external microphone unit 1 for an action camera. The microphone unit 1 has a microphone capsule 10 having a (small) speaking hole 11. The microphone capsule 10 is enclosed by a water-tight enclosure 20. The water-tight enclosure 20 has a water-impermeable passive diaphragm 25. The microphone unit 1 further has a microphone head 30 having a plurality of holes 31, being provided in front of the passive diaphragm 25. In addition the microphone unit 1 has a foam portion 40 which surrounds the head 30 and at least a part of the enclosure 20.

The microphone capsule 10 has a diaphragm 12 and optionally a counter-electrode 13. Optionally the diameter of the speaking hole 11 is 0.5 to 2.5 mm. Preferably the diameter of the speaking hole is 0.9 mm. The water-impermeable passive diaphragm 25 is of such a configuration that it can oscillate freely and can allow the incoming sound to pass substantially undisturbed. The enclosure 20 is of such a configuration that the sound which has passed the passive diaphragm 25 can reach the speaking hole 11 of the microphone capsule 10 and thus the microphone diaphragm 12 without being disturbed so that the sound can be suitably detected or recorded.

According to an aspect of the present invention the passive diaphragm 25 has an oscillatable minimum area of 20 $mm^2$. The passive diaphragm 25 can thus be of a minimum diameter of 5 mm if the passive diaphragm 25 is in the form of a round diaphragm. In an aspect of the present invention the diameter of the passive diaphragm 25 is 9 mm. That gives an oscillatable area of about 60 $mm^2$.

Preferably the oscillatable passive diaphragm 25 has a water-repellent surface. By virtue of the size of the diaphragm 25 and its water-repellent properties a drop of water on the diaphragm cannot cover the complete diaphragm 25. The result of this is that the passive diaphragm 25 can oscillate even when there is a drop of water on the diaphragm so that airborne sound can also be passed to the microphone capsule 10.

The head 30 having the plurality of holes 31 serves as mechanical protection for the passive diaphragm 25. In that respect the head 30 is of such a configuration that it does not impede the oscillations of the passive diaphragm 25. The holes 31 in the head 30 are provided to allow sound to pass unimpeded. If the microphone unit 1 is immersed in water and is then removed again it can happen that drops of water cover the holes 31. To prevent this a foam portion 40 is placed over the head 30. In that case the head 30 is in contact with the foam portion 40 which has a corresponding recess 41 in which the head 30 and the water-tight enclosure 20 can be placed. Optionally the foam portion 40 can serve as wind protection. The foam portion 40 has an open-pore foam with a predominant pore size. The pores are of such a configuration that, upon removal of the microphone unit 1 from water, they suck the water residues away from the holes 31 in the head 30 like a sponge so that the holes 31 of the head 30 are cleared. The pores of the foam portion however are at the same time selected to be of such a size that they cannot independently retain water. This means that water residues in the foam portion, after removal of the microphone unit 1 from the water, run for the greatest part downwardly out of the foam under the effect of the force of gravity.

According to the invention the predominant pore size of the foam portion 40 is in the range of between 0.3 and 1.5 mm. The foam portion 40 has a pore density in ppi (pores per inch) of 15 ppi to 80 ppi. A pore density of about 30 ppi is particularly advantageous.

Optionally the foam material used can be a foam "Regicell 30 ppi". In this respect Regicell is a polyester filter foam produced by Woodbridge Foam Partner.

According to an aspect of the invention the design configuration of the passive diaphragm 25, the head 30 with the holes 31 and the foam portion 40 with the specified pore sizes provides a microphone unit which can be readily immersed in water and then removed again, wherein the water on the passive diaphragm 25 and/or in the holes 31 can flow away within a very short time, for example faster than two seconds, so that the microphone capsule 10 in the microphone unit 1 can detect and record airborne sound very quickly after removal from the water.

According to an aspect of the present invention the enclosure 20 has a carrier layer 26. The carrier layer 26 can represent an open-pore carrier layer, for example comprising a damping silk, and it serves to support the passive diaphragm 25 from the interior if the microphone unit 1 is operated under water. The carrier layer 26 is thus provided at a small spacing relative to the passive diaphragm and behind the diaphragm. The carrier layer 26 is provided in particular in the interior of the enclosure 20. That is advantageous because in that way the water-repellent outside of the passive diaphragm 25 remains unchanged and water on the passive diaphragm can flow away quickly. In that case the carrier layer 26 is arranged spaced from the passive diaphragm 25 so that it does not touch the passive diaphragm 25 in normal operation. It is only when the passive diaphragm 25 is urged in the direction of the carrier layer 26 by a strong outside pressure as occurs when it is immersed in water to a relatively great depth, that contact occurs between the carrier layer 26 and the passive diaphragm 25 so that the desired supporting effect is achieved. That is advantageous as the passive diaphragm 25 does not have to be designed in such a way that it can withstand the water pressure on its own. That is also advantageous as a supporting function for a diaphragm is difficult to combine with a requirement for acoustic transparency. In addition a spacing is optionally provided between the carrier layer 26 and the speaking hole 11.

Optionally the region of the enclosure 20, at which the passive diaphragm 25 is fixed, is of such a configuration that there is no peripherally extending raised portion around the edge of the passive diaphragm 25. Such a step which extends around the edge of the passive diaphragm 25 could impede the drainage of drops of water and is therefore to be avoided. For the same reason the head 30 is optionally also of such a configuration that the holes 31 extend into the plane of the passive diaphragm 25 so that the head 30 also does not form a closed peripherally extending raised portion around the edge of the passive diaphragm 25.

Figure 2:
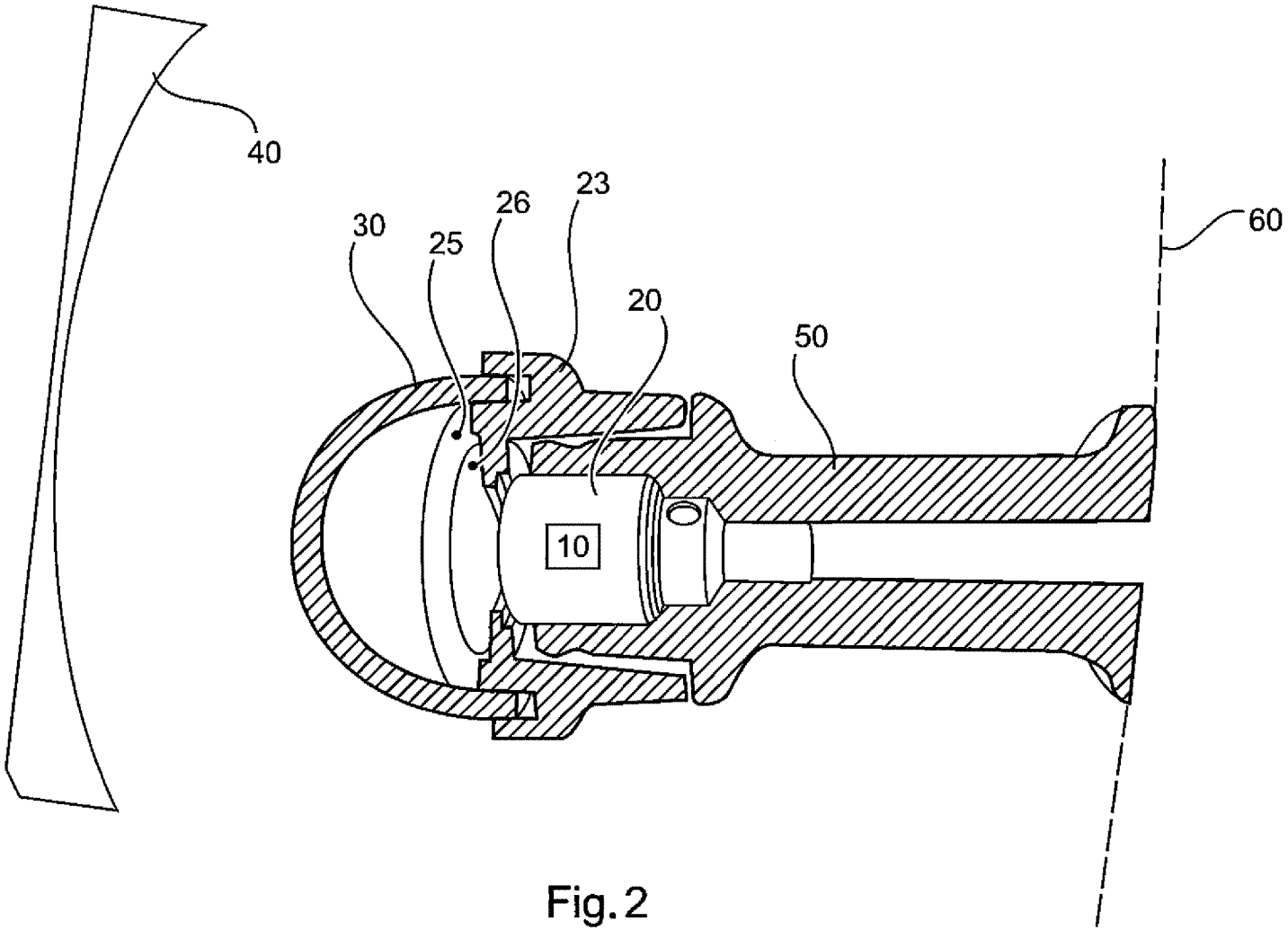
FIG. 2 shows a diagrammatic sectional view of a microphone unit according to a second embodiment.

FIG. 2 shows a diagrammatic sectional view of a microphone unit 1 according to a second embodiment. The microphone unit of the second embodiment substantially corresponds to the microphone unit of the first embodiment. A microphone capsule 10 is enclosed by a water-tight enclosure 20. The microphone capsule 10 or the enclosure 20 is held by a holder 50 which for example can be fixed to a housing 60 of an action camera. The holder 50 is in particular water-tightly fixed to the housing 60. In that case the holder 50 is optionally flexible. That has inter alia the advantage that the transmission of structure-borne sound from the housing 60 to the microphone capsule 10 is reduced. In addition the risk of the microphone unit 1 breaking off is reduced by the flexible configuration. As the microphone unit 1 like also the action camera is worn near to the body when the user is involved in sporting activity the projecting microphone unit 1 could also entail a risk of injury for the user, and this is avoided by the holder 50 being of a flexible configuration. Feed lines which electrically connect the microphone capsule 10 to the action camera can be guided in the interior of the holder 50. Optionally the holder 50 forms a part of the enclosure 20. Overall this then gives a water-tight system which includes the microphone unit 1, the holder 50 and the housing 60.

A cap 23 can be placed on the enclosure 20. The cap 23 has a protective diaphragm 25 which is in the form of a passive water-impermeable diaphragm. The protective diaphragm 25 can optionally be slackly tensioned and shaped so that it is acoustically transparent. An open-pore damping silk 26 is provided in the region of the enclosure 20. The damping silk 26 can serve to improve the acoustic properties (smoothing of the frequency response) and to provide mechanical support for the protective diaphragm 25, in particular in the case of a static pressure (for example at a depth of immersion of up to 1 m). The diameter of the hydrophobic protective diaphragm 25 can correspond to the diameter of the protective diaphragm 25 of the first embodiment. Thus there is provided a protective diaphragm 25 in respect of which a drop of water on the protective diaphragm 25 cannot cover the complete diaphragm. For further mechanical protection of the protective diaphragm 25 there is provided a head 30 having a plurality of holes 31. That head can be for example in the form of a gauze head.

A foam portion 40 which can serve as wind protection can be provided around the head 30. The foam portion 40 is in contact with the head 30 and serves to drain water from the head.

Figure 3:
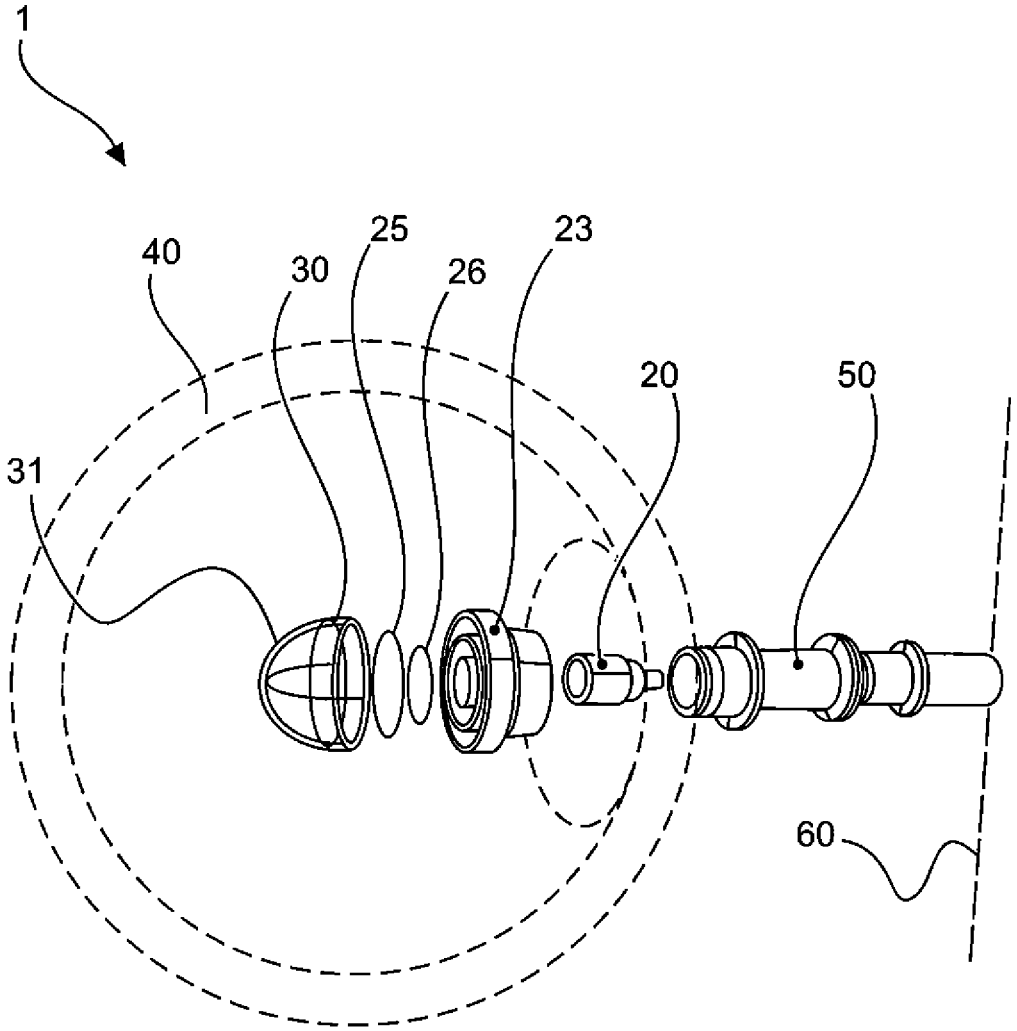
FIG. 3 shows an exploded view of the microphone unit according to the second embodiment.

FIG. 3 shows an exploded view of the microphone unit of the second embodiment. The microphone unit thus has a holder 30, an enclosure 20 having a microphone unit 10, a cap 23, optionally a carrier layer 26, a protective diaphragm 25, a head 30 having a plurality of holes 31 and a foam portion 40.

While this invention has been described in conjunction with the specific embodiments outlined above, it is evident that many alternatives, modifications, and variations will be apparent to those ordinarily skilled in the art. Accordingly, the preferred embodiments of the invention as set forth above are intended to be illustrative, not limiting. Various changes may be made without departing from the spirit and scope of the inventions as defined in the following claims.

The invention claimed is:

1. A microphone unit for an action camera, comprising:

a microphone capsule having at least one speaking hole, a water-tight enclosure which water-tightly encloses the microphone capsule, wherein the water-tight enclosure has a water-impermeable passive diaphragm that is configured to oscillate and allow incoming sound to pass substantially undisturbed, a head having a plurality of holes, wherein the head is provided outside the water-tight enclosure in front of the water-impermeable passive diaphragm, and a foam portion which is provided in front of the head and has an open-pore foam, wherein the foam portion contacts the head, wherein the water-impermeable passive diaphragm has an oscillable minimum area of 20 $mm^2$;

wherein the foam portion has pores which are sized so that the foam portion can suck water residues away from the holes in the head like a sponge, wherein the pores are of such a size that they cannot independently retain water, wherein after the microphone unit has been placed in water, water residues, after removal of the microphone unit from the water, run downwardly out of the foam portion under an effect of a force of gravity;

wherein the foam portion has a pore density of 15 ppi to 80 ppi.

2. A microphone unit according to claim 1 and further comprising:

a carrier layer for supporting the water-impermeable passive diaphragm, wherein the carrier layer is arranged within the water-tight enclosure behind the water-impermeable passive diaphragm, wherein the carrier layer is arranged spaced from the water-impermeable passive diaphragm so that it is not in contact with the water-impermeable passive diaphragm in normal operation.

3. A microphone unit according to claim 1 further comprising:

a holder which is adapted to fix the microphone unit to a housing of the action camera.

4. A microphone unit according to claim 3, wherein the holder is flexible.

5. A microphone unit according to claim 1, wherein a diameter of the at least one speaking hole ranges from 0.5 to 2.5 mm.

6. A microphone unit according to claim 1, wherein a region of the water-tight enclosure, at which the water-impermeable passive diaphragm is fixed, is of such a configuration that there is no peripherally extending raised portions around an edge of the water-impermeable passive diaphragm.

7. A microphone unit according to claim 1, wherein the water-impermeable passive diaphragm has an oscillable area of about 20 $mm^2$ to about 60 $mm^2$.

* * * * *